US010675206B2

(12) United States Patent
Kirschey

(10) Patent No.: US 10,675,206 B2
(45) Date of Patent: Jun. 9, 2020

(54) ELECTRICALLY DRIVEN WHEELED WALKER

(71) Applicant: Disco Drives Kirschey, Wuppertal (DE)

(72) Inventor: Gerhard Kirschey, Wuppertal (DE)

(73) Assignee: Disco Drives Kirschey GmbH, Wuppertal (DE)

( * ) Notice: Subject to any disclaimer, the term of this patent is extended or adjusted under 35 U.S.C. 154(b) by 0 days.

(21) Appl. No.: 16/194,302

(22) Filed: Nov. 17, 2018

(65) Prior Publication Data

US 2019/0151185 A1 May 23, 2019

(30) Foreign Application Priority Data

Nov. 22, 2017 (DE) ..... 10 2017 127 568

(51) Int. Cl.

| | |
|---|---|
| ***A61H 3/04*** | (2006.01) |
| ***A61G 5/04*** | (2013.01) |
| *A61G 5/02* | (2006.01) |

(52) U.S. Cl.

CPC ..... *A61H 3/04* (2013.01); *A61G 5/045* (2013.01); *A61G 5/047* (2013.01); *A61G 5/022* (2013.01); *A61G 5/025* (2013.01); *A61H 2003/043* (2013.01); *A61H 2003/046* (2013.01); *A61H 2201/0107* (2013.01); *A61H 2201/0161* (2013.01); *A61H 2201/0192* (2013.01); *A61H 2201/1207* (2013.01); *A61H 2201/1633* (2013.01); *A61H 2201/1635* (2013.01); *A61H 2203/0406* (2013.01)

(58) Field of Classification Search

CPC ..... A61H 3/04; A61H 2003/043; A61H 2003/046; A61G 5/045; A61G 5/047; A61G 5/022; A61G 5/04; A61G 5/041; A61G 5/042; A61G 5/043; A61G 5/046

USPC ..... 180/65.1

See application file for complete search history.

(56) References Cited

U.S. PATENT DOCUMENTS

| | | | | |
|---|---|---|---|---|
| 1,565,719 A | | 12/1925 | Dunkley | |
| 3,872,945 A | * | 3/1975 | Hickman | A61G 5/042 180/65.6 |
| 4,096,920 A | | 6/1978 | Heyn | |
| 6,651,993 B1 | | 11/2003 | Emerzian et al. | |
| 8,006,766 B2 | | 8/2011 | Zarowny et al. | |

(Continued)

FOREIGN PATENT DOCUMENTS

| | | |
|---|---|---|
| CN | 20586979 U | 11/2017 |
| DE | 10355161 A1 | 12/2004 |

(Continued)

*Primary Examiner* — John D Walters
(74) *Attorney, Agent, or Firm* — Von Rohrscheidt Patents

(57) ABSTRACT

A wheeled walker including a first wheel pair that is in front in a driving direction and a second wheel pair that is behind in the driving direction; a frame that includes struts that are oriented backward against the driving direction wherein each of the struts supports a rear wheel of the second wheel pair; a platform that is attached at the wheeled walker and that includes at least one wheel and a standing surface for a person using the wheeled walker; and an electric motor drive that is configured to propel the wheeled walker at least in the driving direction, wherein the standing surface of the platform is arranged between the wheels of the second wheel pair.

11 Claims, 15 Drawing Sheets

(56) References Cited

U.S. PATENT DOCUMENTS

| | | | | |
|---|---|---|---|---|
| 8,006,786 | B1 * | 8/2011 | Chapman | A61G 5/1094 180/65.1 |
| 9,376,155 | B2 * | 6/2016 | Ying | B62K 3/002 |
| 9,744,095 | B1 | 8/2017 | Mazzei et al. | |
| 10,285,894 | B1 * | 5/2019 | Haenel | A61H 3/04 |
| 10,286,977 | B1 * | 5/2019 | Haenel | B62K 27/14 |
| 2013/0069344 | A1 | 3/2013 | Moliner | |
| 2019/0016407 | A1 * | 1/2019 | Rosemeyer | B62K 11/007 |

FOREIGN PATENT DOCUMENTS

| | | | |
|---|---|---|---|
| DE | 102005014613 | A1 | 10/2006 |
| DE | 102007062406 | B4 | 7/2009 |
| DE | 202009009547 | * | 10/2009 |
| DE | 102011106561 | A1 | 12/2011 |
| DE | 202013007716 | U1 | 11/2013 |
| DE | 202016002904 | U1 | 9/2016 |
| DE | 202017004591 | U1 | 10/2017 |
| DE | 102017003482 | A1 | 11/2017 |
| DE | 202017107072 | U1 | 12/2017 |
| EP | 1020173 | A2 | 7/2000 |
| EP | 2451423 | B1 | 5/2012 |
| WO | WO9916653 | A1 | 4/1999 |
| WO | WO2005030105 | | 4/2005 |
| WO | WO201617064 | A1 | 1/2011 |

* cited by examiner

PRIOR ART

ELECTRICALLY DRIVEN WHEELED WALKER

RELATED APPLICATIONS

This application claims priority from and incorporates by reference German patent application DE 10 2017 127 568.1 filed on Nov. 22, 2017.

FIELD OF THE INVENTION

The invention relates to an electrically-driven wheeled walker.

BACKGROUND OF THE INVENTION

Wheeled walkers serving as walking aids for people with limited mobility are well known in the air. They enable the users to run every day errands. They do not only help to avoid falls of people with limited mobility, but they also enable the people to safely transport loads like everyday shop purchases. In particular, people that need more assistance than a classic cane would provide but who would be severely limited in their mobility by a wheelchair gain an increased range through the wheeled walker.

Depending on their mobility limitation or required range it can be very hard for people to move with the wheeled walker. Several options for an electric drive have been proposed in the prior art. Thus, EP 2 451 423 B1 discloses a walker with a trailing platform which includes an electric motor drive. A user can step on the platform and start the drive. The wheeled walker and the user are then moved forward by the electric motor drive. The platform disclosed in EP 2 451 423 B1 is raisable into a storage position by the electric motor drive.

DE 10 2007 062 406 B4 also discloses a wheeled walker with an electric drive. Also here the transport platform runs in trail wherein a separate drive wheel is arranged at the wheeled walker to provide forward propulsion.

DE 20 2013 007 716 U1 illustrates a trailing device for strollers which however can also be used for a wheeled walker according to the description. The embodiment is characterized in particular in that a steerable wheel is arranged in a steering center of the combination that includes the wheeled walker and the attached transport platform.

DE 20 2016 002 904 U1 also shows a walker with an electrical drive. The electrical drive is again a trailing device that is attached at an axis between the rear wheels of the wheeled walker.

Last not least, there are DE 103 55 161 A1 and DE 10 2005 024 613 A1 which disclose electrically driven trailing devices for strollers and shopping carts.

All the known devices have in common that the trailing device that is attached to the wheeled walker, stroller or shopping cart includes a standing surface for a person, so that the person and the leading device (stroller, shopping cart, wheeled walker) are propelled by the electric drive.

Devices of this type are particularly advantageous for people with limited mobility which have to go up slopes or cannot reach a destination without a break due to exhaustion unless they have an electro motoric auxiliary drive.

The presented solutions are typically configured as retrofits. Partially the trailing devices can be moved into a storage position when they are not being moved or they can be removed from the walker.

BRIEF SUMMARY OF THE INVENTION

Thus, it is an object of the invention to provide an electrically driven wheeld walker that is safe to handle for a user.

The object is achieved by a wheeled walker including a first wheel pair that is in front in a driving direction and a second wheel pair that is behind in a driving direction; a frame that includes rearward-oriented struts wherein each of the rearward oriented struts supports a rear wheel of the second wheel pair; a platform that is attached at the wheeled walker and that includes at least one wheel and a standing surface for a person using the wheeled walker; and an electric motor drive that is configured to propel the wheeled walker at least in the driving direction, wherein the standing surface of the platform is arranged between the wheels of the rear wheel pair.

The essential advantage of the invention is to have figured out that the arrangement of the trailing platform that transports the user is ergonomically disadvantageous in the prior art. In the prior art the trailing platform is arranged behind a position of the user during non-powered movement of the wheeled walker.

Arranging the platform approximately at the location where a user is located when the wheeled walker is used without electric propulsion, the person can assume an ergonomically advantageous upright body posture through the platform arrangement according to the invention. Simultaneously the combination including the walker and the platform is much more tipping stable than the prior art when the platform is arranged according to the invention, in particular when the platform that is provided by the standing surface is arranged completely or at least with approximately half its surface area in front of a geometric axis that runs through the rotation axles of the rear wheels.

It is provided that the platform includes a backward tapering standing surface.

Thus, it is provided in particular that the platform is provided with at least one wheel at its rear end, wherein the wheel is configured in particular as a drive wheel with an integrated electric motor.

A backward tapering platform, in particular with a backward tapering standing surface and with a single wheel that is centrally arranged at a rear end of the platform, in particular a drive wheel, provides good support for the platform through the rear drive wheel. The rear drive wheel is provided with a high surface pressure due to the physically acting forces so that a risk of wheel slippage is minimized. The backward tapering standing surface furthermore corresponds to the approximately trapezoid contact surface of the feet of a standing person. The invention utilizes this fact in that it adapts the platform to the standing surface and tapers it in backward direction. Thus, more usable space is provided between the rear wheels of the wheeled walker, in particular when the combination drives around turns, which facilitates tighter curve radii.

Thus, it is provided that the platform carries a battery to power the electric motor with electric current, wherein the electric motor is arranged in particular at a bottom side of the platform or in a receiving shaft on the top side of the platform.

In an advantageous embodiment it is provided that all additional components of the electric motor drive in addition to the battery, for example, the drive control, possibly charge control electronics for the battery are arranged at the platform. It is overall advantageous for the center of gravity of the platform and of the combination when the battery is arranged below the platform. It is conceivable to provide a compartment or a drawer at this location so that the battery can be removed for charging purposes. It is also conceivable to permanently install the battery at this location and provide it with a plug connection for charging, in this case the platform has to be moved close to a power outlet in order to charge the battery. A battery that is arranged below the platform has the advantage that the standing surface that is formed on the topside of the platform is maximized.

In order to facilitate retrieval or replacement of a battery, it is, however, conceivable to provide a shaft or a support on the platform to receive the battery. The shaft or the support can also have room for diverse control and electronic components. The shaft or the support is ideally oriented along the longitudinal axis of the platform that is oriented in driving direction and divides the platform into two standing surface halves, so that the shaft is arranged between the feet of the user when using the platform.

When all components that are essential for the electro motoric operation are part of the platform, they are removed from the wheeled walker together with the platform so that a changeover from the motor driven wheeled walker to non-motorized operation can be performed with one manipulation.

An operating element for adjusting the propulsion speed of the wheeled walker, for example a twist handle, can be connected wirelessly with the control that is arranged on the platform. When a wire connection is run from the operating element to the control, the wire connection is separatable in the portion of a coupling arrangement between the platform and the wheeled walker, in particular by a separatable plug connection. A radio connection according to Bluetooth standard, however, is preferred.

The wheeled walker is provided with a coupling arrangement that arranges the platform at the wheeled walker so that tension and compression are transferable.

Thus, it is provided that the coupling arrangement facilitates simple connecting and disengaging of the platform at the wheeled walker. Consequently the wheeled walker can be converted in a simple manner from motorized to non-motorized operations. Advantageously the coupling arrangement is retrofitable at commercially available wheeled walkers and remains at the wheeled walker. Thus, it can be, for example, a coupling rod that is arranged between struts that support the rear wheels, in particular when the wheeled walker is foldable parallel to an axis that runs transversal to the movement direction.

Wheeled walkers that are foldable along an axis that is parallel to the movement direction are typically configured with scissor levers so that the coupling arrangement can also be configured as a coupling rod. This coupling rod is inserted into holders after unfolding the wheeled walker, wherein the holders are inserted into struts that support the rear wheels. These can be in particular coupling rod forks. Alternatively, it is conceivable that the coupling arrangement is connected to a bracket at the rolling walker in the portion of the intersecting scissor levers.

The invention provides that the coupling arrangement includes a joint which facilitates relative position changes of the wheeled walker and the platform that are caused by a pitch movement and defines a rotation axis between the wheeled walker and the platform, wherein the combination of wheeled walker and platform pivots about the rotation axis when going around a turn.

Thus, it is provided that the coupling arrangement includes at least two rotation axes. A first axis extends transversal to the movement direction. A second axes extends essentially vertically to the platform surface. Thus, the axis that is oriented transversal to the movement direction compensates for pitch movements. The vertically oriented axis serves as a rotation axis, and the combination kinks about the rotation axis when the combination runs about a turn. There is no relative movement between the wheeled walker and the platform about the longitudinal axis of the wheeled walker. The connection is torque-proof with respect to this axis.

It is furthermore provided that the coupling arrangement is provided with a horizontal axis wherein the platform is movable about the horizontal axis from a usable functional position into a storage position.

Thus, it is provided in particular that the horizontal axis that is used for displacing the platform between the functional position and the idle position coincides with the axis that compensates for pitch movement.

It is furthermore provided that the platform is arranged below the coupling arrangement in the functional position of the platform and supported in the coupling arrangement by a vertical strut.

Thus, it is particularly advantageous when the coupling arrangement has a thrust receiver that receives the vertical strut and in which the vertical strut is movably supported.

The thrust receiver facilitates to move the platform in its storage position in a direction towards the front wheels of the wheeled walker and thus keep the room between the rear wheels free to provide a movement space for the user.

It is furthermore provided that the coupling arrangement includes a lift assist by which the movement of the platform is supported from a functional position into the storage position wherein a mechanical lift assist like, e.g., a lift spring, can be provided in particular.

Alternatively the lift assist can also be configured with an electric motor.

It is furthermore provided that the wheel is provided with a protective device that is rotatable about the whell axis and oriented towards the user of the wheeled walker in the storage position of the platform and covers the running surface of the wheel that is oriented towards the user.

The provided protective device is a fender that covers the wheel and that has double utility. On the one hand side, it protects the user from coming in contact with the drive wheel when using the electric motor drive and thus helps to avoid accidents.

On the other hand side, when the platform is in its storage condition, thus folded up, the fender can be rotated about the wheel axle so that the fender is oriented towards the user of the wheeled walker. Thus, the fender covers a running surface of the drive wheel and protects the user from contaminant particles that may adhere to the drive wheel.

It is furthermore provided that the platform trails also when running through a turn within a surface which is laterally defined by radial planes of the rear wheels.

It is an advantage of the embodiment according to the invention that a very high level of tipping stability is provided for the combination including the wheeled walker and the platform.

Another improvement of the stability is achieved when the contact surface of the user on the platform is essentially arranged within a triangle that is formed by the rear wheels of the wheeled walker and by the wheel of the platform.

It is provided that the platform is disengageable from the coupling arrangement.

It is furthermore provided that the platform is foldable along a longitudinal axis that is parallel to the driving direction.

It is an essential advantage of the collapsible platform that it provides better transportability and storability.

Thus, the object of the invention is also achieved by a wheeled walker h the features of independent claim 17, in particular with its characterizing features according to which the platform and the wheeled walker have a common coupling arrangement, wherein the coupling arrangement is arranged between a geometric rotation axis of the rear wheels and a geometric rotation axis of the front wheels.

Due to the arrangement of the coupling arrangement between the front wheels and the rear axis of the wheeled walker the weight of the user standing on the platform also loads the front axle. This effectively prevents a lifting of the front wheels from the ground, in particular when driving up hills or running over obstacles like curbs. The permanent additional load on the front wheels of the wheeled walker also stabilizes when running on flat ground. Thus a driving stability of the wheeled walker is improved over coupling solutions at or behind the geometric rear axis due to part of the weight of the user loading the front wheels as well as the rear wheels of the wheeled walker.

BRIEF DESCRIPTION OF THE DRAWINGS

Further advantages can be derived from the subsequent description of various embodiments with reference to drawing figures, wherein.

DETAILED DESCRIPTION OF THE INVENTION

Figure 1:
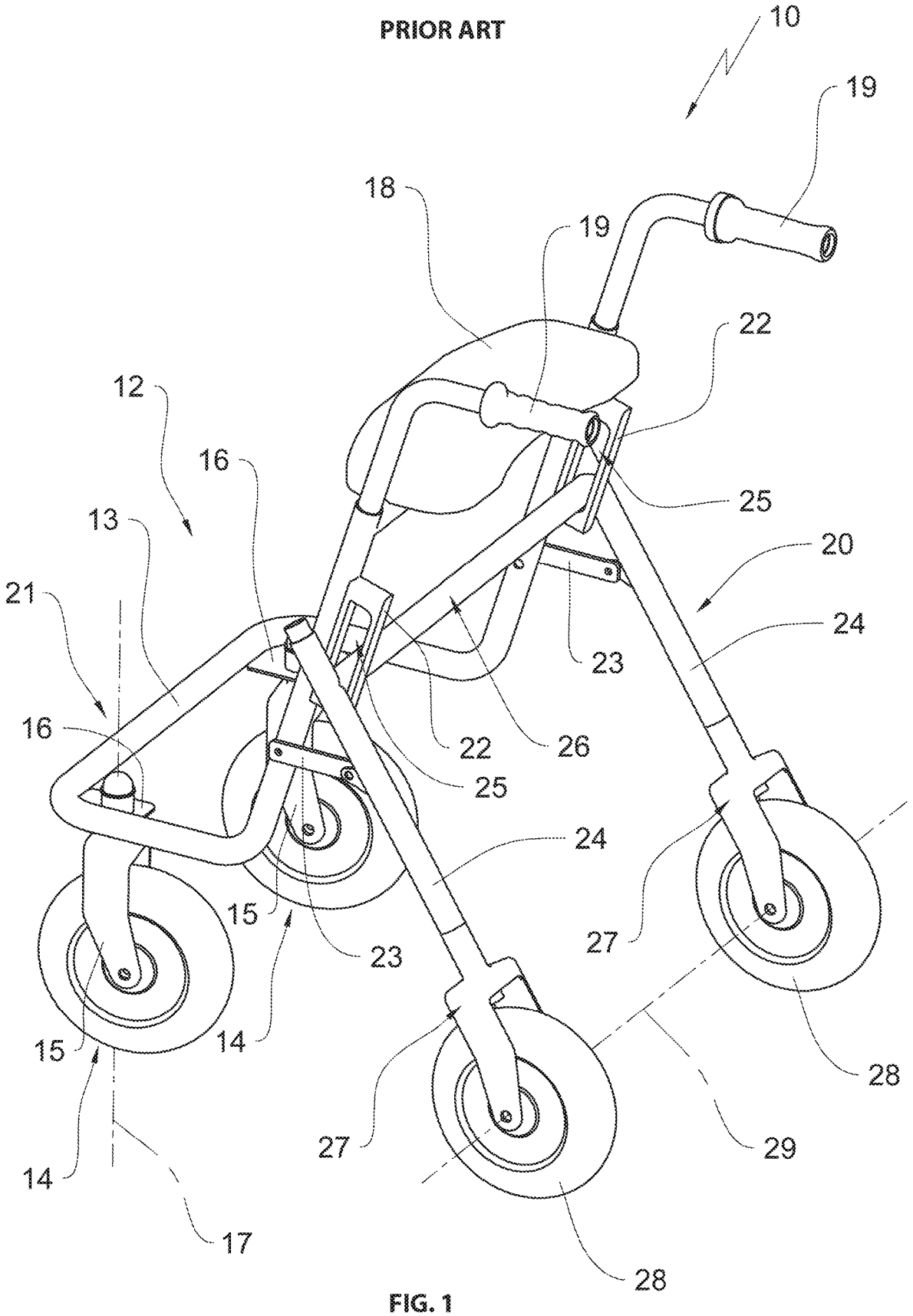
FIG. 1 illustrates a first embodiment of a prior art wheeled walker.
Figure 2:
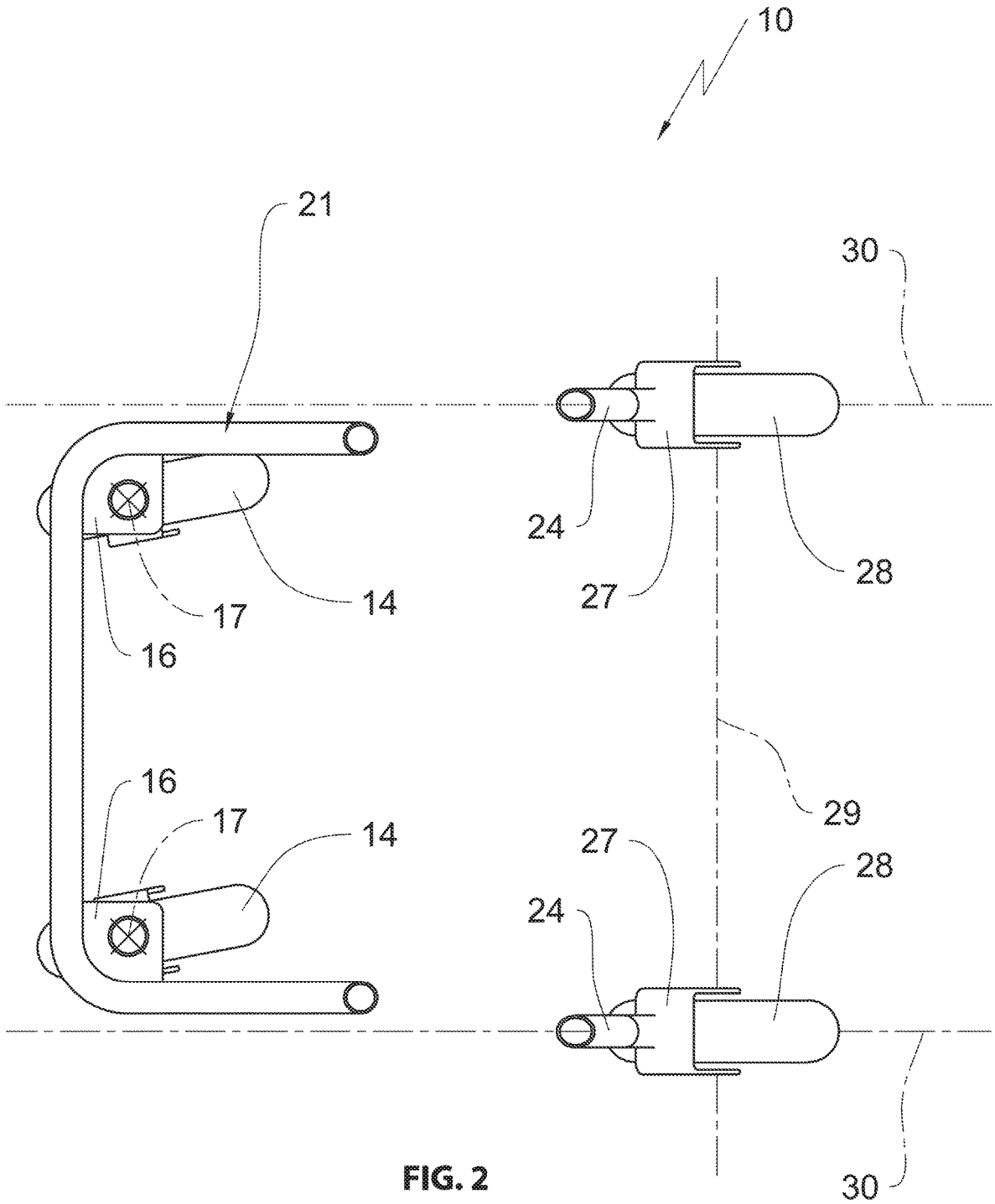
FIG. 2 illustrates a horizontal sectional view of the wheeled walker according to FIG. 1.

In the drawing figures a wheeled walker is overall designated with the reference numeral 10. For starters, FIGS. 1 and 2 illustrate a prior art walker 10 which is supplemented in the subsequent figures in different embodiments with a trailing platform 11 to form a wheeled walker 10 according to the invention. Thus, unless stated differently the general description of the prior art wheeled walker also applies to the wheeled walkers according to the invention, and therefore identical reference numerals are used for identical or analogous components.

FIG. 1 illustrates the prior art wheeled walker 10 in a perspective view. The wheeled walker 10 has a frame that is designated overall with the reference numeral 12 and made from tubular rods 13 which provide attachment for various components. The frame 12 is divided in two and forms a forward frame section 21 and a rear frame section 20. The frame 12 with its forward frame section 21 has two front wheels 14 that are arranged adjacent to each other and that are respectively supported by a front wheel fork 15. Thus, the front wheel forks 15 are pivotably arranged in a wheel fork support 16 about a vertical rotation axis 17 at the frame 12.

The frame 12 thus supports a seat or support plate 18 and two handles 19 which are supported in a telescopable manner in the tubular rod arrangement of the frame 12 in order to facilitate continuous elevation adjustment and thus an adaptation to the height of the user. In a wheeled walker 10 according to the invention at least one of the handles 19 is configured as a twist grip wherein a rotation of the handle provides electricity to a motor. An increasing twist angle of the handle 19 increases motor speed. Thus, the twist grip moves automatically into a zero position when released by the operator. Motorized progress is stopped in the zero position.

The rear frame section 20 is attached at the front frame section 21 by holders 22 with slotted holes and two elbow levers 23.

The rear frame section 20 is essentially made from two struts 24 that are parallel to each other and which are coupled with each other by a horizontal connecting rod 26 that is supported in the holders 22 or its slotted holes 25. Each elbow lever 23 connects a respective strut 24 with the front frame section 21.

Each strut supports a rear wheel fork 27 wherein each rear wheel fork 27 supports a rear wheel 28. The rotation axes of the rear wheels 28 define a geometric rear axis 29 that connects the rear wheels but that is not a physical axle. Thus, the rear wheels 28 are connected in a rigid manner in the rear wheel forks 27, this means in a non-pivotable manner.

The wheeled walker that is illustrated in FIG. 1 is foldable in that the horizontal connecting rod is moved upward in the slotted hole so that the elbow lever joints 23 are folded.

FIG. 2 illustrates the wheeled walker according to FIG. 1 in a vertical sectional view. The sectional plane is slightly above the rear wheel forks 27. This drawing figure illustrates in particular the pivotable support of the front wheels 14 in the wheel fork supports 16. Additionally the geometric rear axis 29 is illustrated which will be relevant in the subsequent drawing description and the radial plane 30 that is defined by each rear wheel 28.

Figure 3:
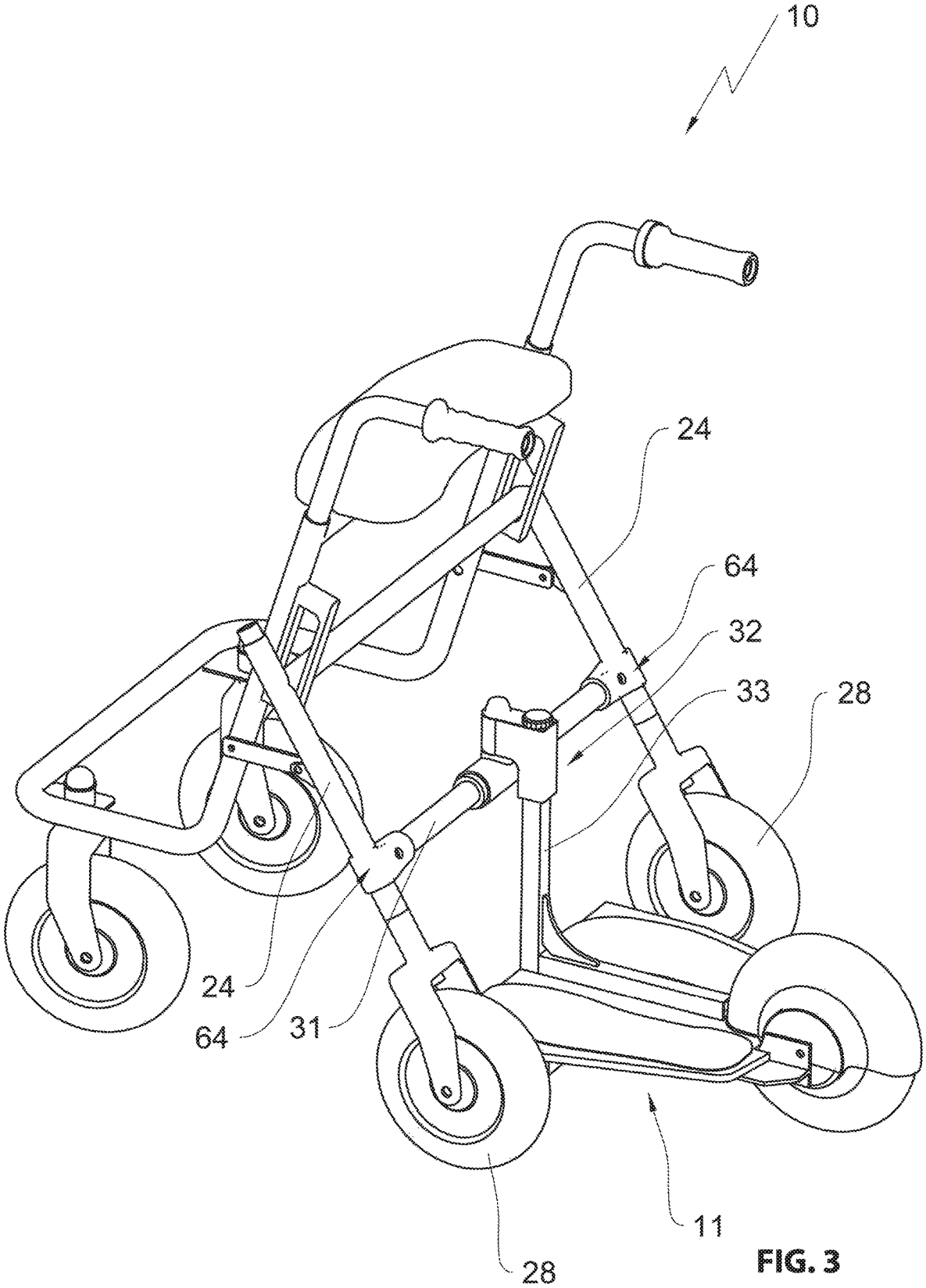
FIG. 3 illustrates the wheeled walker according to the invention in a first embodiment with an attached platform.

FIG. 3 illustrates a wheeled walker 10 according to the invention. The wheeled walker is similar to the prior art wheeled walker but supplemented according to the invention by the trailing platform 11. The invention uses a coupling rod 31, which is oriented horizontal or parallel to the horizontal connecting rod 26 and which connects the rear struts 24 with each other that support the rear wheels 28. The coupling rod 31 is attached at the rear struts 24 by two clamps 64.

The actual coupling arrangement 32 is attached at the coupling rod 31 in which the vertical strut 33 is inserted and establishes a connection between the platform 11 and the coupling arrangement 32. The trailing platform 11 is arranged with its standing surface between the rear wheels 28 so that the user takes a similar position on the platform 11 relative to the handles 19 like when using the wheeled walker without the platform 11. Compared to the prior art solutions, the user of the platform 11 assumes a particularly ergonomic position. Furthermore, the tipping stability of the combination of the wheeled walker 10 and the platform 11 is significantly improved since all four wheels of the wheeled walker are loaded when going through a turn.

Arranging the coupling arrangement between an imaginary geometric rotation axis of the front wheels 14 and an imaginary geometric axis of the rear wheels 28 stabilizes the wheeled walker 10 even when it goes straight. The weight of the user can also be applied to the front wheels 14 so that a risk of lifting the front wheels 14 off the ground is avoided.

Figure 4:
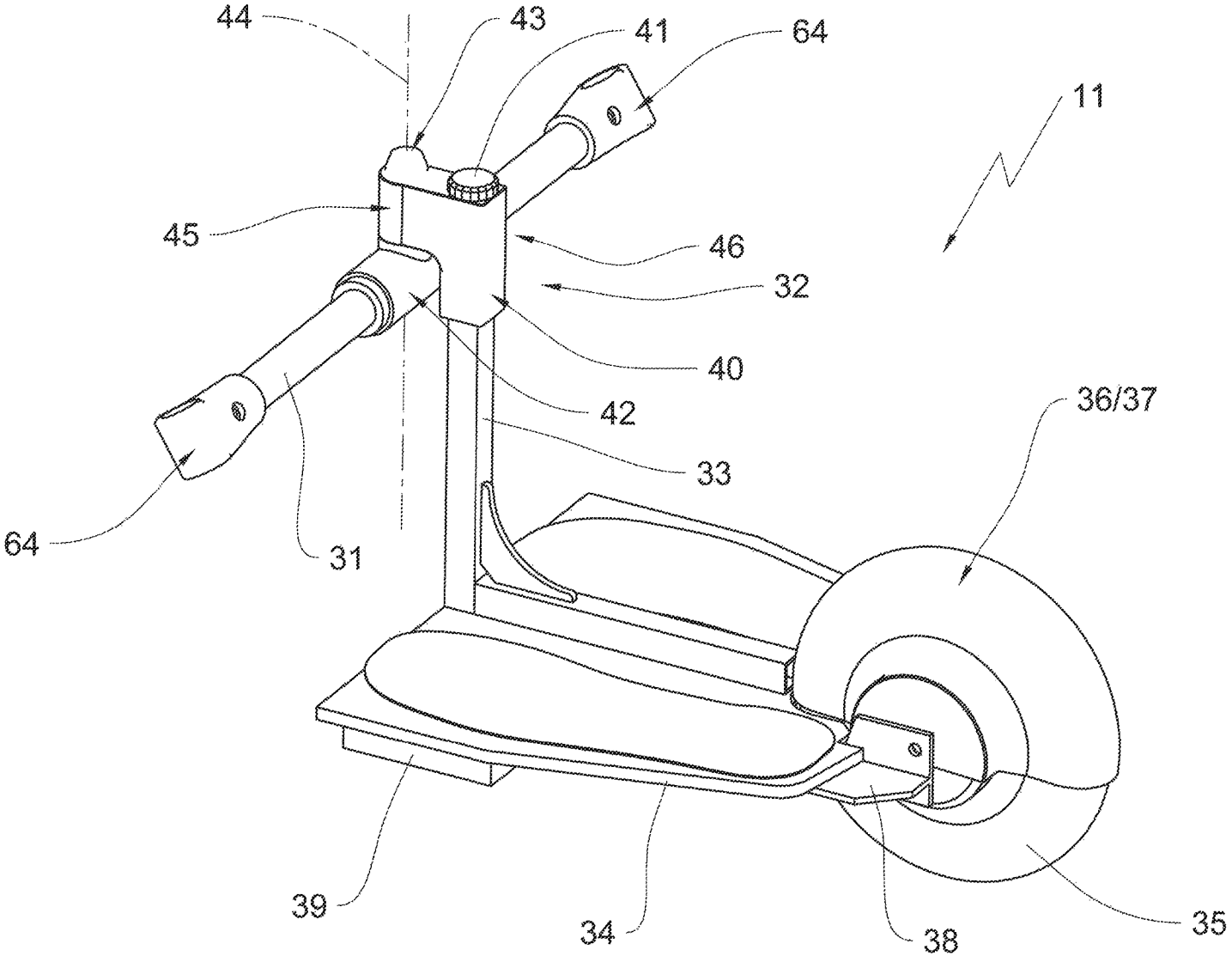
FIG. 4 illustrates the platform according to FIG. 3 by itself.
Figure 5:
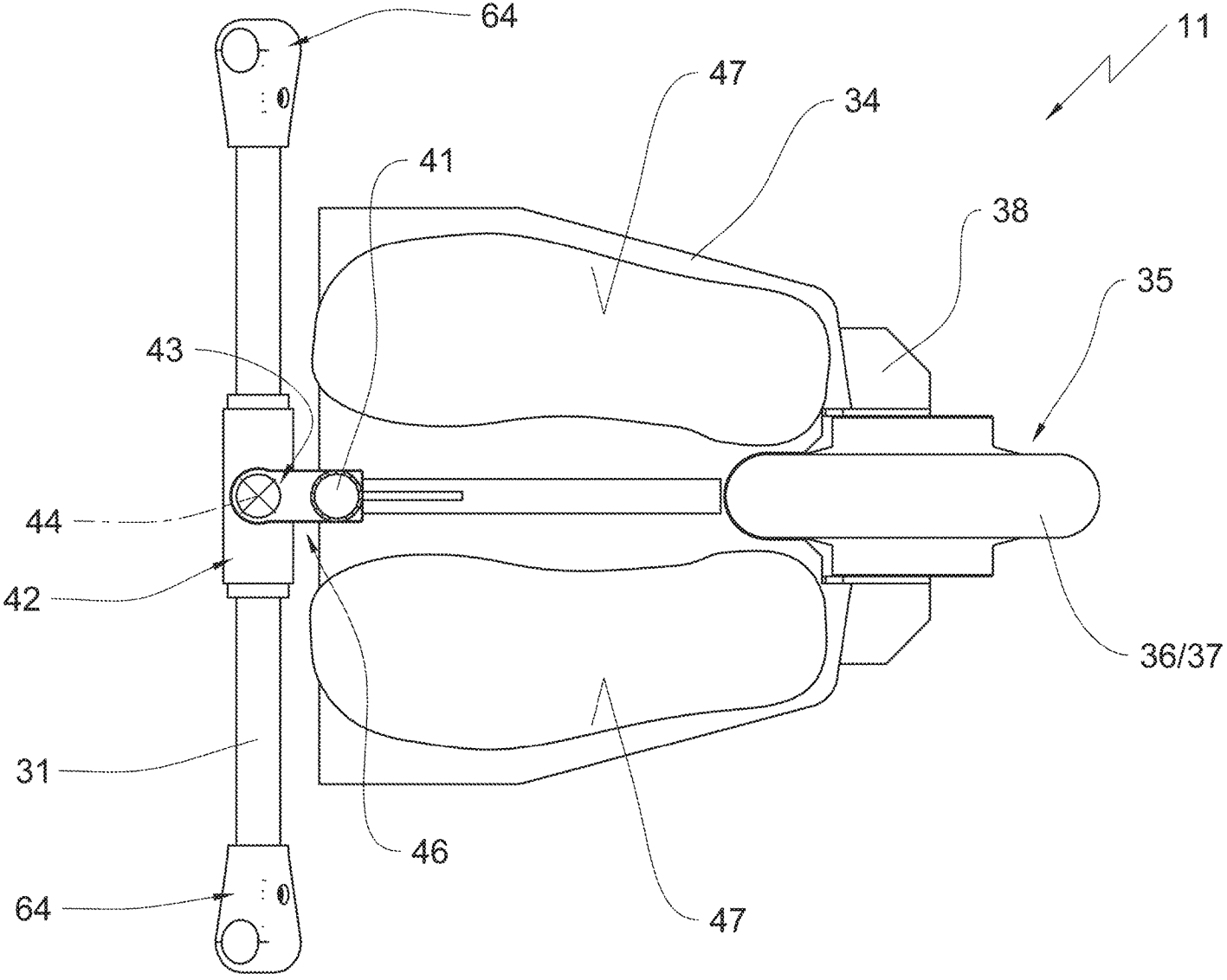
FIG. 5 illustrates the platform according to FIG. 4 in top view.
Figure 6:
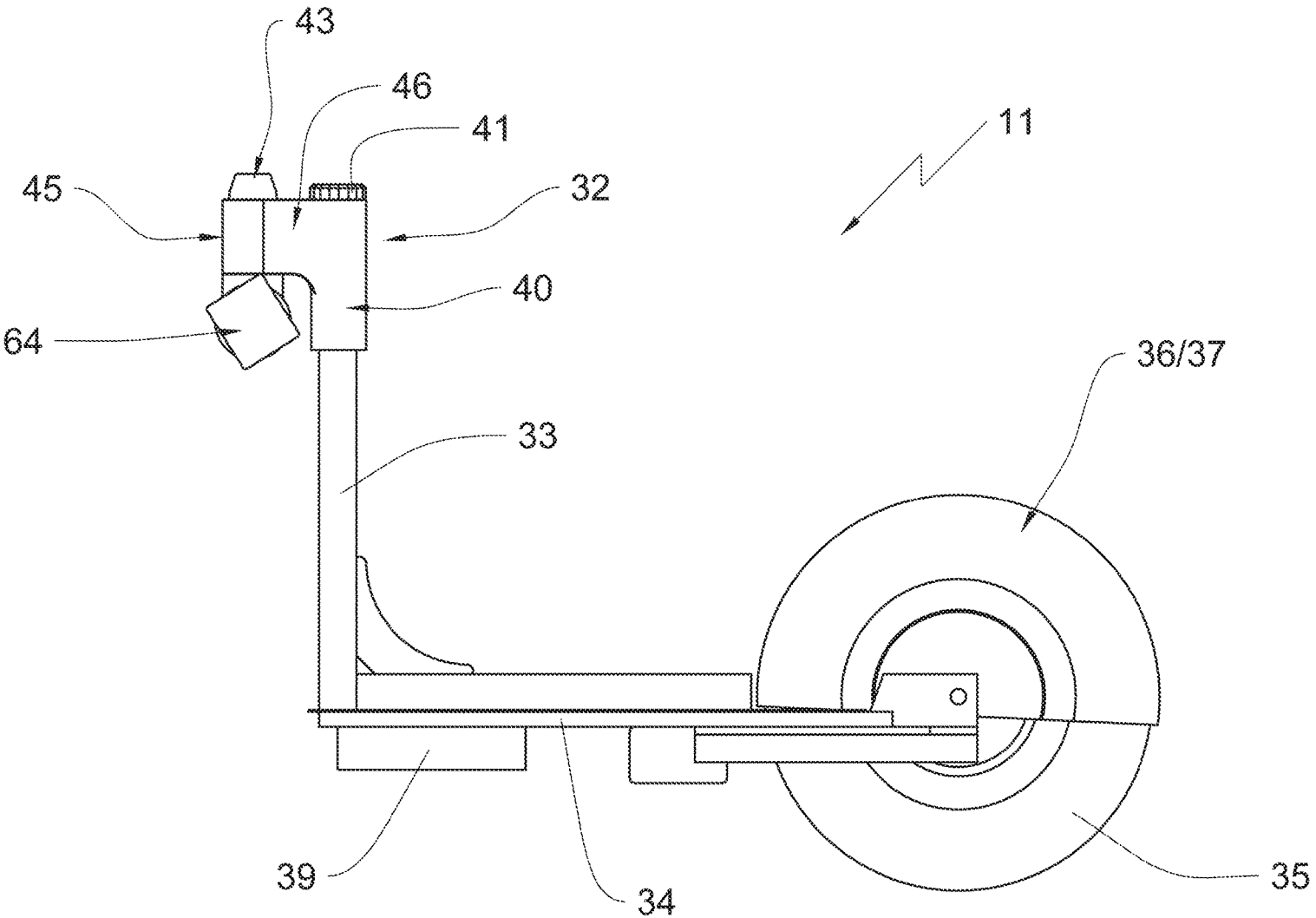
FIG. 6 illustrates the platform according to FIG. 4 in side view.

The trailing platform 11 is illustrated with the coupling rod 31 and the coupling arrangement by itself in FIGS. 4 through 6. The trailing platform 11 initially includes a board 34 which can be produced from wood but also from fiber reinforced synthetic material, in particular polycarbonate or polyimide, but also from other materials.

The platform wheel 24 is arranged at an end of the board 34 that is oriented away from the coupling arrangement, wherein the platform wheel is at least partially covered by a protective device 36 configured as a fender 37 in order to protect the user. A platform wheel fork 38 is attaches the platform wheel 35 at the board 34.

In an advantageous embodiment of the invention an electric motor is integrated into the platform wheel 35, so that the drive unit for the wheeled walker according to the invention is formed by the platform wheel itself. The motor is provided with a brake function which prevents the wheeled walker 10 from accelerating when moving downhill. Advantageously the motor speed is always proportional to a position of the twist handle 19 when voltage is provided to the motor. Idle can be provided in a no current condition or by a separate circuit in order to be able to maneuver the wheeled walker with the platform by hand.

In an advantageous embodiment the maximum speed of the combination of the wheeled walker 10 and the platform 11 can be preselected. This can be helpful in particular for inexperienced users when learning how to use the wheeled walker.

A flat battery 39 is arranged on a bottom side of the board 34 wherein the flat battery stores electric drive energy for the motor driven platform wheel. Ideally the battery 39 is arranged in a shaft that is arranged at a bottom side of the plate 4 wherein control electronics can be arranged in the shaft as well. The battery 39 can be removable from the shaft for charging. However, when the battery 39 is permanently arranged at the plate 34 in a different embodiment, charging contacts are provided in order to provide electricity to the battery.

Arranging the drive wheel 35 at a rear end of the platform 11 helps the stability of the combination of wheeled walker 10 and platform 11 in that the load of the user acts between the coupling arrangements 32 with the platform wheel 35. Thus, surface pressure of the platform wheel 35 can be maximized which prevents possible slippage.

The coupling arrangement 32 includes a thrust receiver 40 in order to connect the vertical strut 33. In this thrust receiver the vertical strut can be moved which will be described in detail infra. In order to provide a movement end stop of the vertical strut 33 that is slide ably supported in the thrust receiver 40 in the functional position of the platform 11 the vertical strut is provided with a retaining bolt 41 at its face. The retaining bolt can be disengaged from the face of the vertical strut 33 in order to separate it from the platform and the coupling arrangement 32 so that the vertical strut 33 is removable from the thrust receiver 40. Furthermore, the platform inclination can be fine-adjusted by the retaining bolt 41.

Figure 4A:
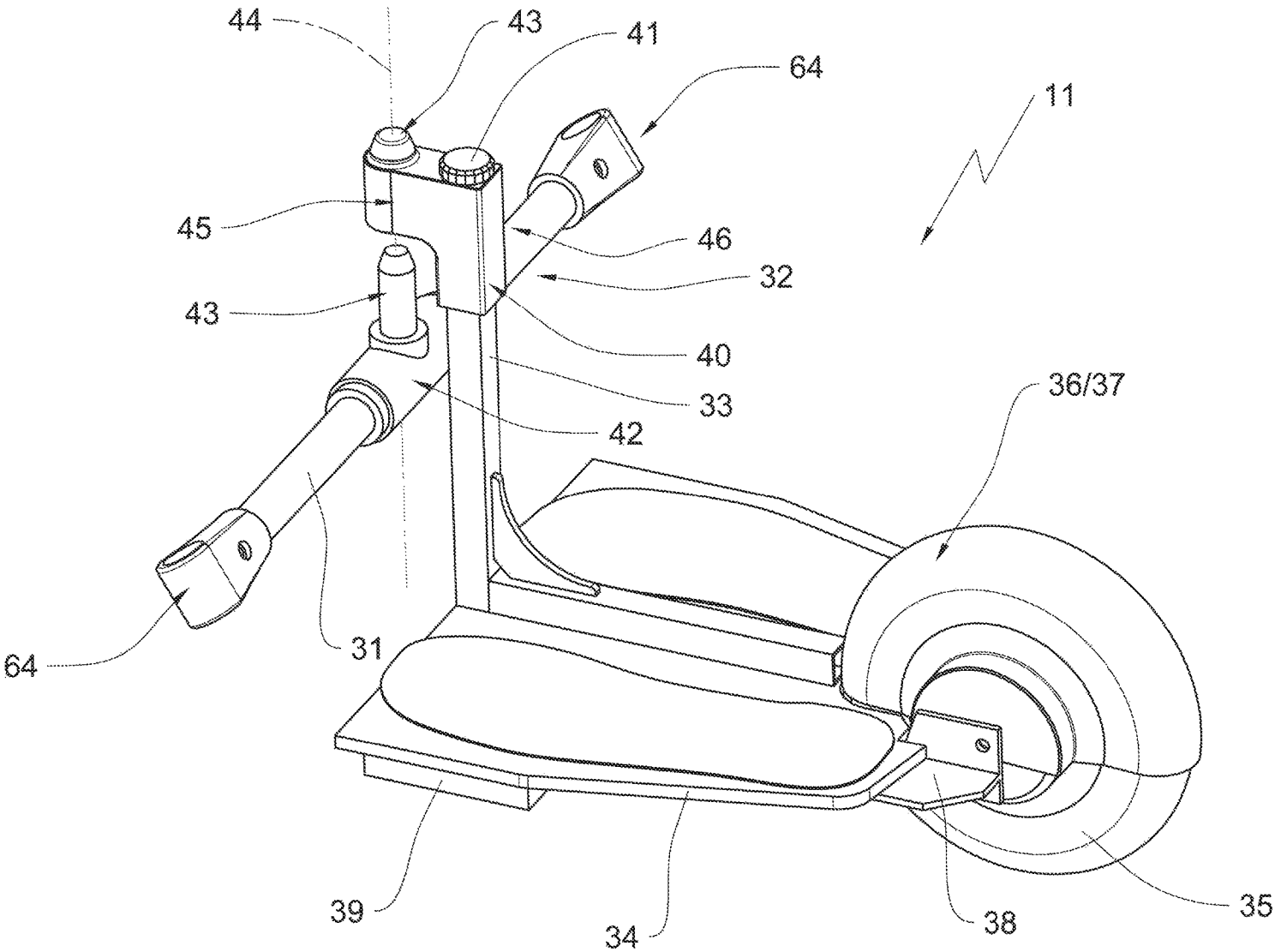
FIG. 4A illustrates the platform according to FIG. 4 with a coupling arrangement that is lifted off from the support pin.

In order to separate the combination of wheeled walker 10 and platform 11, the coupling arrangement 32 is lifted off from the bearing pin 43 as illustrated in FIG. 4*a*. Thus, initially a non-illustrated safety element is removed which prevents unintentional disengagement of the bearing pin 43 and the coupling arrangement 32. When there is a cable connection between the platform 11 and the wheeled walker 10 a plug connection that is arranged in a portion of the coupling arrangement 32 has to be disengaged. The safety element which typically secures the connection between the coupling arrangement 32 and the bearing pin 43 can be used to support the bearing pin 43 against turning out of the vertical. This can be advantageous in particular when the bearing pin 43 is force loaded in order to facilitate a displacement of the platform 11 which will be described infra.

The coupling arrangement 32 is used among other things also for compensating pitch movements of the combination that is formed from the wheeled walker 10 and the platform 11 and in order to define a rotation axis between the wheeled walker 10 and the platform 11 wherein the combination kinks about the rotation axis when going through a turn. In order to compensate pitch movements the coupling arrangement 32 initially includes a horizontal sleeve section 42 which is rotatably supported on the coupling rod 31. The sleeve section 42 includes a vertically oriented bearing pin 43 which forms the vertical rotation axis 44 of the coupling arrangement 32 and which is formed by a bearing sleeve of a support arm 46 forming the thrust receiver 40 (c.f., FIG. 4A).

As evident in particular from FIG. 5 showing a top view of the platform 11, the plate 34 of the platform 11 is tapered in a backward direction towards the platform wheel 35 and includes an approximately trapezoid section. Thus, the board is shaped approximately according to a contour of a natural standing surface of a human. The surfaces 47 indicate feet resting on the plate 34. The essential advantage of the trapezoid configuration of the plate 34 or of a trapezoid board section is in particular that more space is provided for the platform 11 between the rear wheels 28 when driving the wheeled walker 10 according to the invention through turns. Also, using only a platform wheel 35 at a platform end as illustrated in the embodiments helps to optimize the movement space between the rear wheels 28 of the wheeled walker 10 that is available for going through turns. Alternatively, also two twin wheels that are arranged directly adjacent to each other at the platform end can be used.

As indicated already in the introduction and as defined in the patent claims, the platform 11 is movable from a functional position on the ground into a storage position. This is illustrated in FIGS. 7 and 8.

In order to be moved from the functional position into the storage position the platform 11 is raised and the wheel is moved approximately to the elevation of the seat or support plate 18. This corresponds approximately to a pivot movement by approximately 90°. In different embodiments the pivot movement can exceed a 90° angle, so that the platform wheel 35 is placed on the support plate 18. This has advantages for supporting the wheel in the storage position since an optimized center of gravity is obtained.

In order to be moved into its storage position the platform 11 is moved towards the front wheels 14 in that the vertical strut 33 is moved in the thrust receiver 40 of the coupling arrangement 32 in a direction towards the front wheels 14. This way the platform 11 is moved into its storage position so that it is out of a movement range of a user operating the wheeled walker. Therefore, the wheeled walker 10 can be used without limitations when the platform 11 is within the storage position. In particular, sufficient knee clearance is provided so that walking can be performed without limitations.

Figure 7:
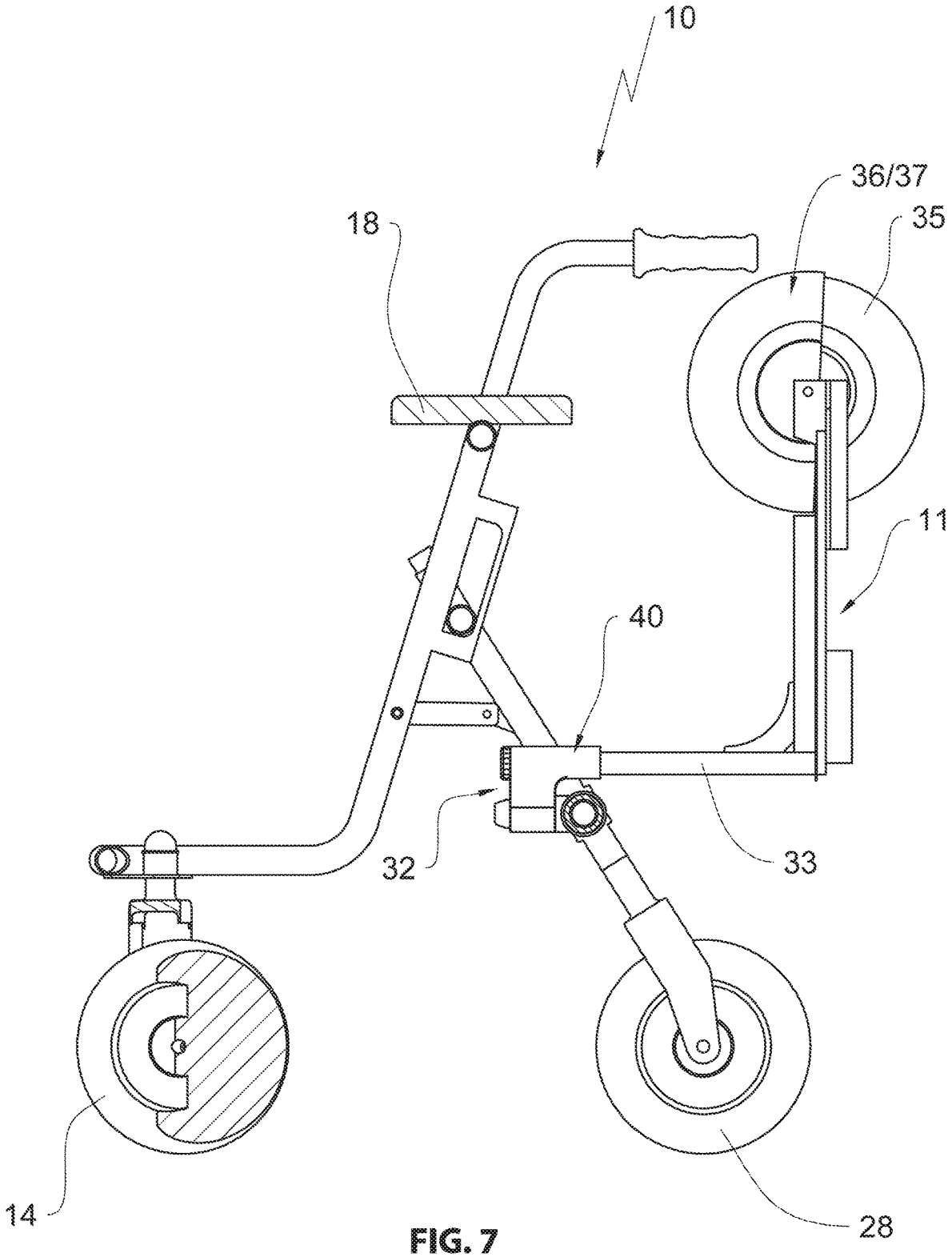
FIG. 7 illustrates the wheeled walker according to FIG. 3 in a vertical sectional view with the platform raised.
Figure 8:
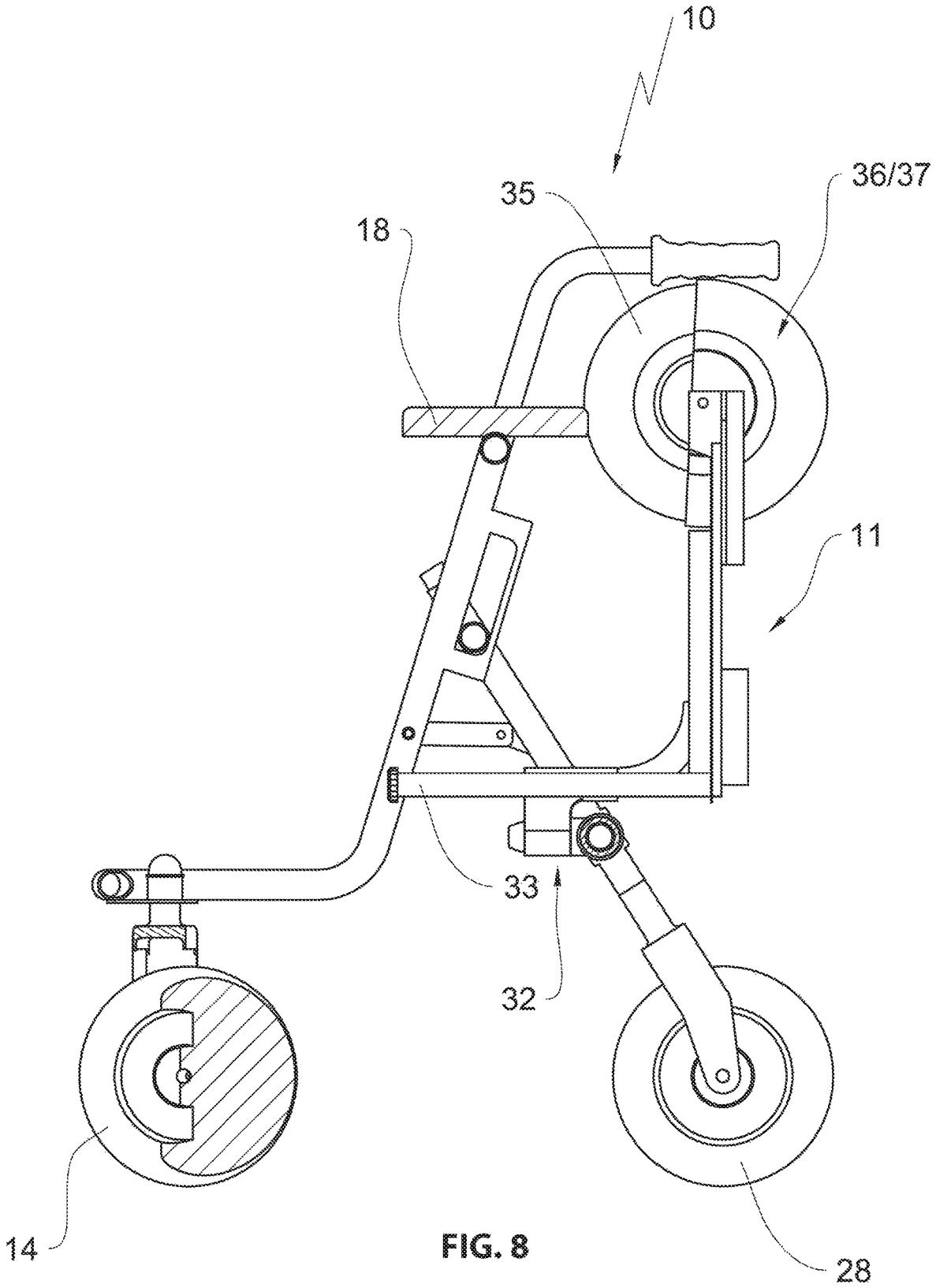
FIG. 8 illustrates a view according to FIG. 7 with the platform in a storage position.

Comparing in particular FIGS. 7 and 8, an orientation of the protective device 36 has been changed. The protective device 36 or the fender 37 is arranged so that it is pivotable about the wheel axis. Thus, the platform 11 is rotatable in the storage position by approximately 180° about the platform wheel 35 and thus oriented towards the user of the wheeled walker 10. This way the platform wheel 35 is covered and the user of the wheeled walker is protected against contaminant particles adhering to the platform wheel 35.

In order to facilitate a displacement of the platform 11 between a functional position and a storage position, the coupling arrangement 32 includes a pivot axis. In the embodiment, the pivot axis coincides with the coupling rod 31, so that the axis that compensates for pitch movements of the combination is identical with the horizontal pivot axis for displacing the platform 11 between the functional position and the storage position.

In order to support the pivot movement from the functional position into the storage position, a support with an electric motor or a mechanical support can be provided. In particular, a mechanical support is provided that uses a torsion spring that is arranged on the coupling rod 31. The pivot movement can also be supported by a gas-pressure spring.

The platform 11 can be supported in its storage position by interlocking elements which can be, for example, semi-spherical interlocking indentations which are arranged in an intermediary space between the coupling rod 31 and the sleeve section 42. In addition, a support belt or a magnet can be provided by which the platform 11 is secured in the storage position.

Figure 9:
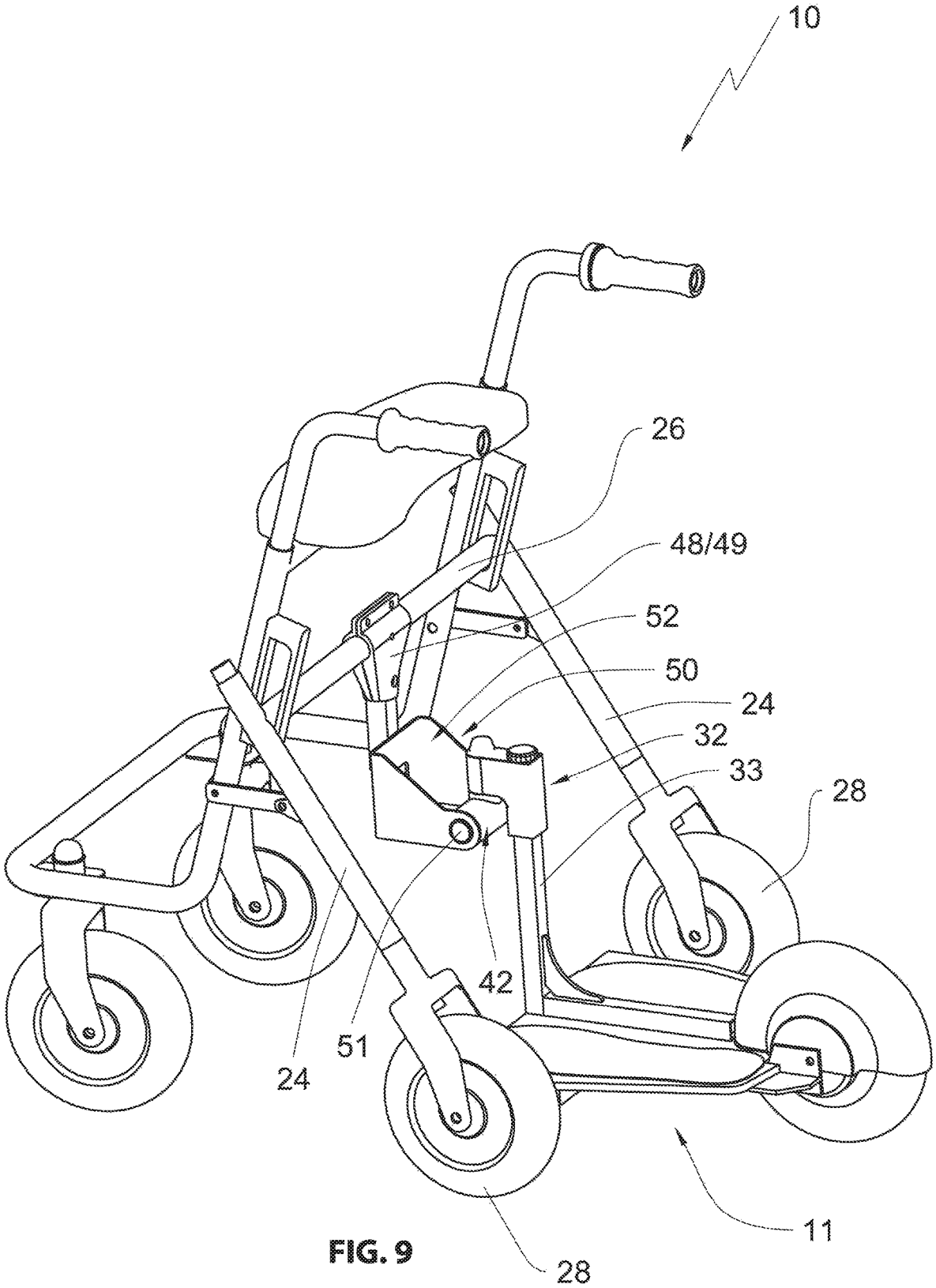
FIG. 9 illustrates the wheeled walker according FIG. 3 with an alternative platform attachment at an existing transversal rod.

FIG. 9 illustrates a different embodiment of the invention using the wheeled walker 10 described supra. A horizontal connecting rod 26 is used to attach the platform 11 at the wheeled walker 10 wherein the struts 24 that support the rear wheels 28 are arranged at each other by the horizontal connecting rod 26. Thus, a coupling basket 50 is attached at the wheeled walker 10 by a suitable attachment element 48, thus a clamping arrangement 49. The coupling basket 50 in turn supports the coupling arrangement 32 that is configured as described supra. The coupling basket 50 itself forms an axle element 51 about which the sleeve section 42 of the coupling arrangement 32 is supported.

The coupling basket 50 includes a thrust recess 52 through which the vertical strut 33 of the platform is slidable when the platform 11 is arranged in its storage position. Then the coupling basket 50 is simultaneously used to support the platform 11 in its storage position wherein the vertical strut 33 is supported at the wheels of the thrust recess 52 and thus blocks a rearward displacement of the platform 11 into its functional position.

Figure 10:
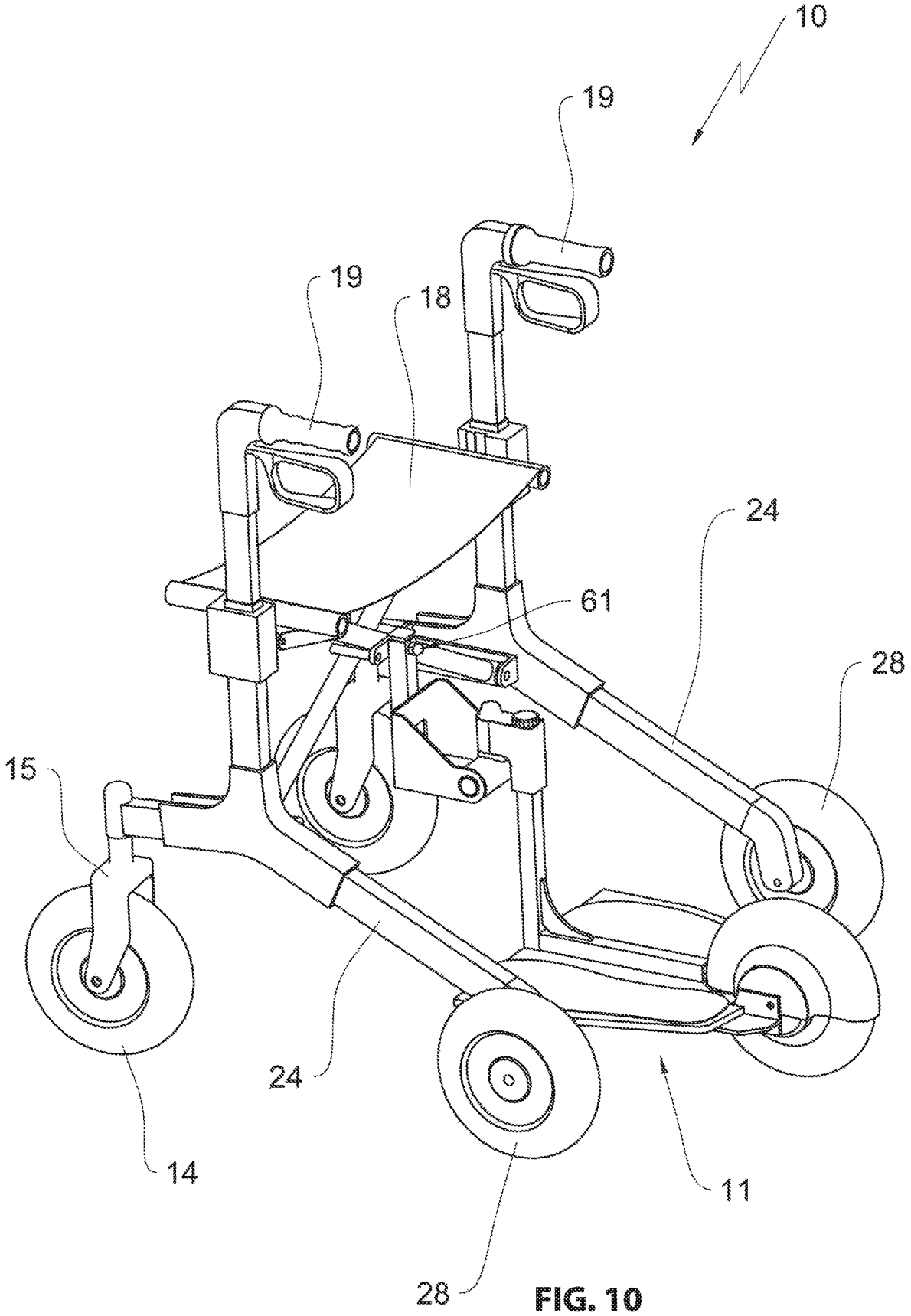
FIG. 10 illustrates a wheeled walker according to the invention in a second embodiment with a platform.
Figure 11:
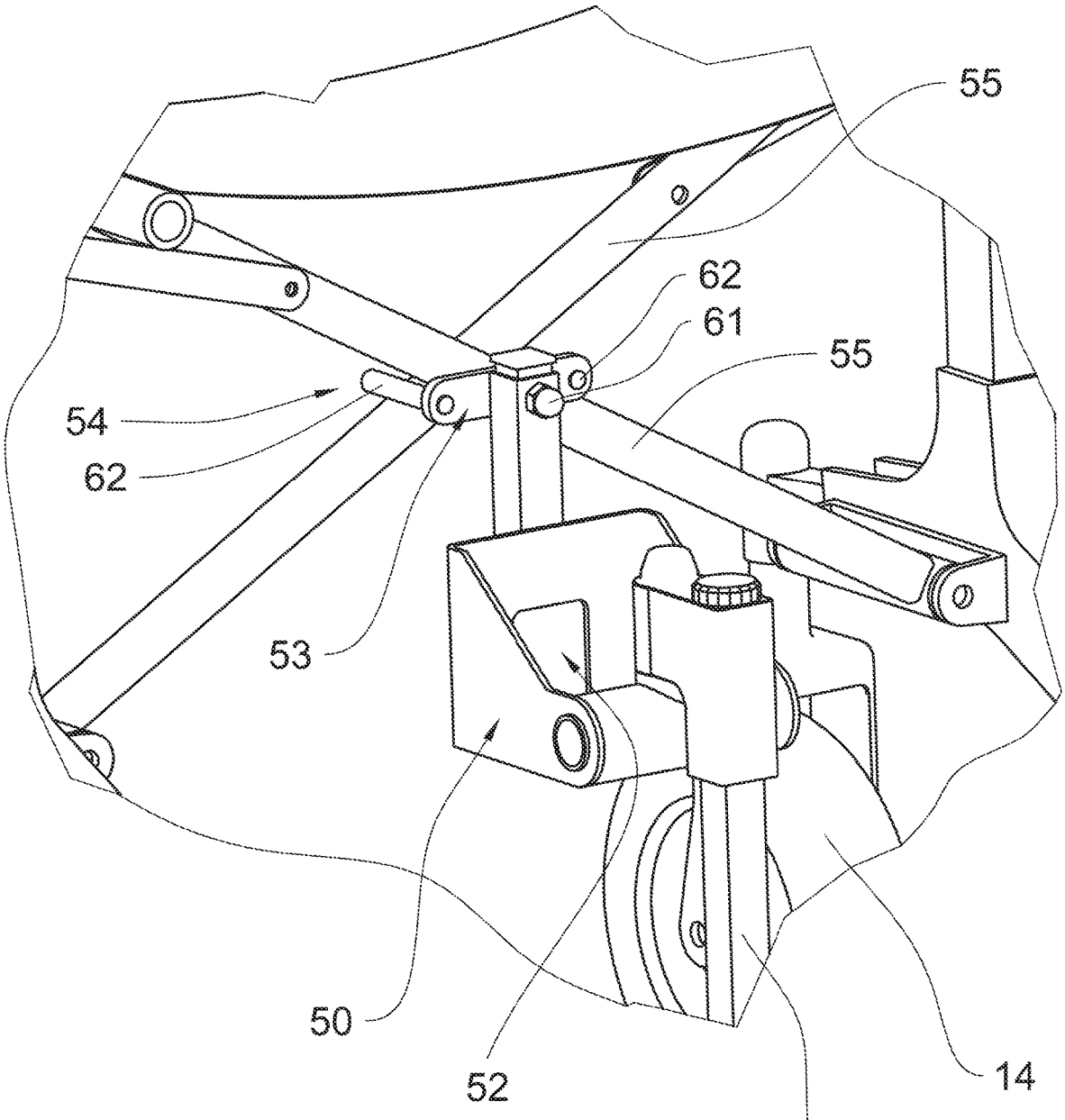
FIGS. 11 and 12 illustrate detail views of the platform attachment at the wheeled walker according to FIG. 10.
Figure 12:
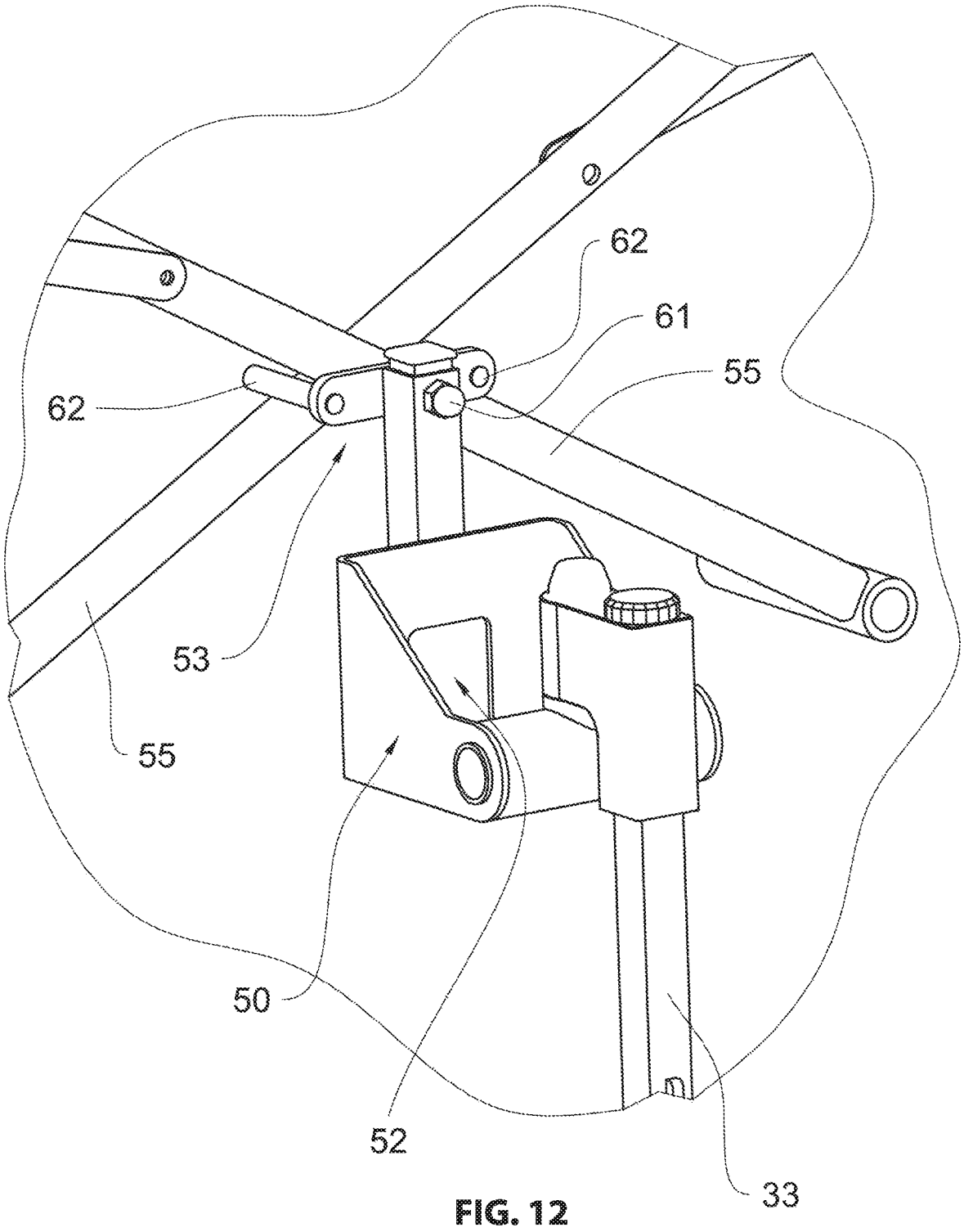

FIGS. 10 through 12 illustrate an alternative configuration of a wheeled walker 10 in an overall view and in two detail views, wherein the wheeled walker is configured according to the invention with a trailing platform 11. Differently from the wheeled walker 10 described supra, the illustrated wheeled walker 10 is collapsible by a scissor mechanism. In order to fix the platform 11 in this embodiment, the coupling basket 50 that was already described supra is fixed at the scissor axis 61 that connects the scissor levers 55 and which is formed by a threaded bolt. Using an attachment bracket 53 which envelopes the intersection portion of the scissor levers 55 and whose support struts 62 rest on the scissor levers 55 prevents a lateral tilting of the platform 11. This reliably prevents a rotating or pivot movement about the scissor axis 61.

Figure 13:
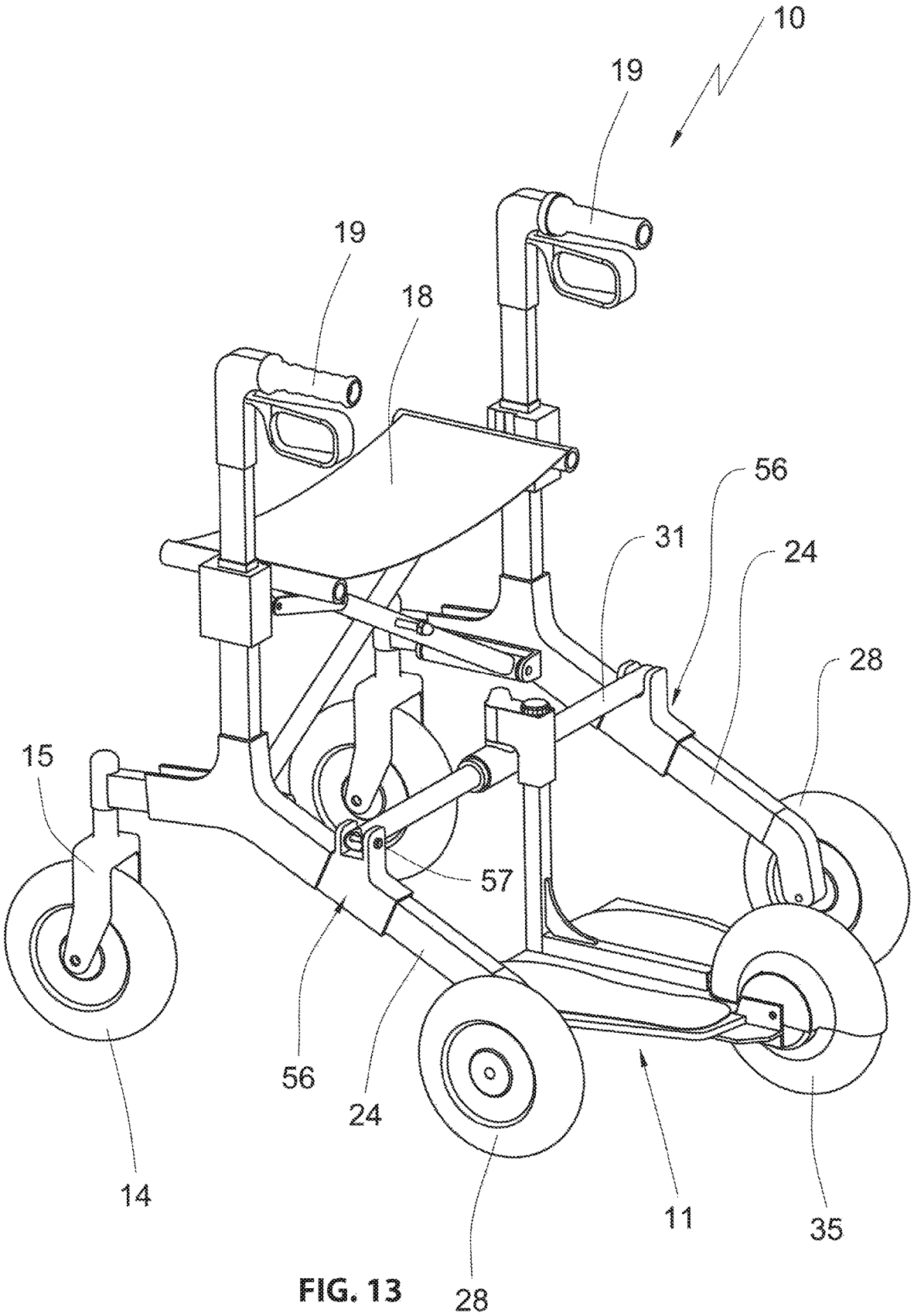
FIG. 13 illustrates the wheeled walker according to FIG. 10 with an alternative platform attachment.

FIG. 13 illustrates the wheeled walker 10 according to FIG. 9 with a platform 11 that is attached in an alternative manner. Thus, the struts 24 that support the rear wheels 28 are provided with receiving forks 56 into which a coupling rod 31 is inserted. Consequently, the platform 11 is fixed in analogy to the wheeled walker that is illustrated and described in FIG. 3.

It is conceivable that the coupling rod 31 is pivotably attached by a threaded bolt 57 in one of the receiving forks 56 in the embodiment according to FIG. 13. Alternatively, however, it is also conceivable that the coupling rod 31 is retrievably supported in the receiving forks 56 and secured therein by suitable elements in the functional position.

Figure 14:
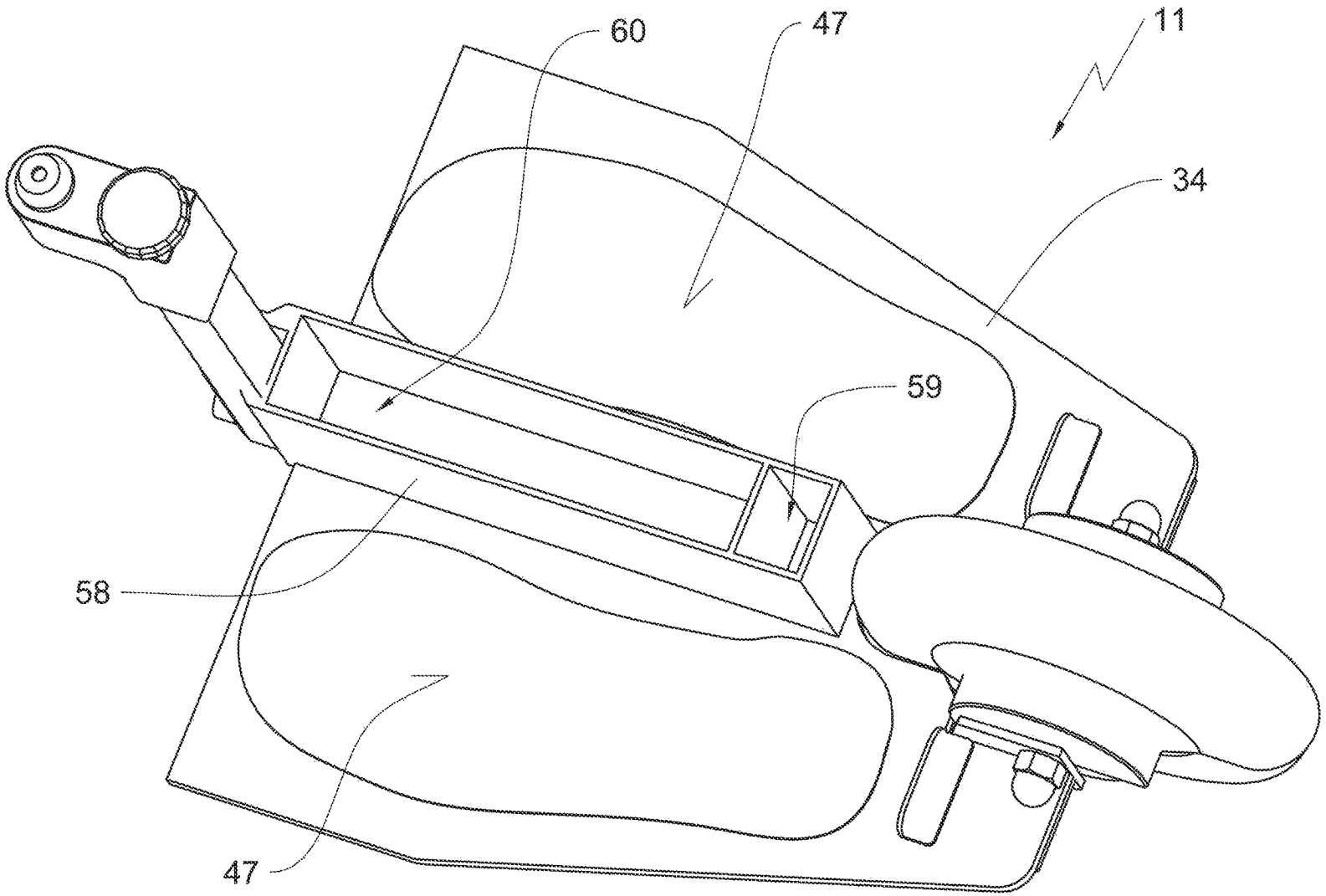
FIG. 14 illustrates an alternative platform in a perspective view.

Last not least, FIG. 14 illustrates an alternative embodiment of the platform 11. This embodiment differs from the embodiment recited supra in particular in that a housing 58 is arranged at a topside of the board 34. The housing 58 is open, this means illustrated without an associated cover. The housing 58 includes a first receiving cavity 59 which can include, e.g., control electronics. A second receiving cavity 60 is used for receiving a non-illustrated battery 39. Also here it is conceivable to retrieve the battery for charging purposes. Alternatively, charging contacts can be provided at an outside the housing 58 or at the battery housing in order to be able to charge the battery also during the installation within the second receiving cavity.

The wheeled walker 10 can be provided with an optical or acoustic signal generator like a bell or a horn in order to warn other traffic partners or to alert them. When the wheeled walker 10 includes a sensor that scans the drive path, the signal generator can be used to put out a warning signal, e.g., to warn for obstacles. A braking process can then also be triggered in the engine control.

It is conceivable to provide the wheeled walker 10 with lighting. Thus, it can be lighting similar to lighting of street legal vehicles, however lighting of the wheeled walker drive path appears more important. This type of drive path illumination facilitates detecting obstacles or uneven ground early enough when using paths that are not well illuminated.

A display at the wheeled walker or data coupling with a mobile unit enables displaying status information to the user of the wheeled walker 10. The status information can be charge status, estimated range or speed, however integrating a navigation function is also conceivable.

Advantageously the wheeled walker 10 according to the invitee includes a master switch proximal to one of the handles 19 or the coupling arrangement 32. This master switch enables or interrupts the electrical connection between the power source and the electrical consumers, in particular the motor. A control light signals a position of a master switch.

The platform 11 that is configured as a drive component can be used to drive other transportation devices like strollers, wheel chairs or product transportation devices like carts of mail carriers. When the platform 11 is used as a drive for a wheel chair the accompanying person can climb on the platform 11.

REFERENCE NUMERALS AND DESIGNATIONS

10 wheeled walker
11 trailing platform
12 frame
13 tubular linkage
14 front wheel
15 front wheel fork
16 wheel fork holder
17 vertical rotation axis of 16
18 seat—support plate
19 support handle
20 rear frame section
21 front frame section
22 holder of 21
23 elbow lever
24 strut
25 slotted hole of 22
26 horizontal connecting rod
27 rear wheel fork
28 rear wheel
29 geometric rear wheel axis
30 radial plane of 28
31 coupling rod
32 coupling arrangement
33 vertical strut
34 board
35 platform wheel
36 protective device
37 fender
38 platform wheel fork
39 battery
40 thrust receiver
41 retaining bolt
42 sleeve section
43 bearing pin
44 rotation axis of 32
45 bearing sleeve
46 support arm
47 surface
48 attachment element
49 clamping device
50 coupling basket
51 axel element of 50
52 thrust recess
53 attachment bracket
54 intersection portion of 55
55 scissor lever
56 receiving fork
57 threaded bolt
58 housing
59 first receiving cavity
60 second receiving cavity
61 scissor axis
62 support strut
64 clamp

What is claimed is:

1. A wheeled walker, comprising:

a first wheel pair that is in front in a driving direction and a second wheel pair that is behind in the driving direction;

a frame that includes struts that are oriented backward against the driving direction wherein each of the struts supports a rear wheel of the second wheel pair;

a platform that is attached at the wheeled walker and that includes at least one wheel and a standing surface for a person using the wheeled walker; and an electric motor drive that is configured to propel the wheeled walker at least in the driving direction, wherein the standing surface of the platform is arranged between the wheels of the second wheel pair, wherein the wheeled walker includes a coupling arrangement that arranges the platform at the wheeled walker so that tension and compression loads are transferable between the platform and the wheeled walker, wherein the coupling arrangement is provided with a joint which facilitates a displacement of the wheeled walker and the platform relative to each other that is caused by pitch movements, wherein the joint defines a rotation axis between the wheeled walker and the platform, and wherein a combination including the wheeled walker and the platform kinks about the rotation axis when driven around a turn.

2. The wheeled walker according to claim 1, wherein the coupling arrangement is provided with a horizontal axis about which the platform is movable from an operating functional position into a storage position.

3. The wheeled walker according to claim 2, wherein the coupling arrangement includes a lift assist by which a movement of the platform is supported from a functional position into a storage position, and wherein the lift assist is mechanical and includes a lift spring.

4. The wheeled walker according to claim 1, wherein the coupling arrangement is part of a coupling rod that connects struts that support the rear wheels.

5. The wheeled walker according to claim 1, wherein the platform is arranged below the coupling arrangement in a functional position and supported in the coupling arrangement by a vertical strut.

6. The wheeled walker according to claim 5, wherein the coupling arrangement includes a thrust receiver which receives the vertical strut so that the the vertical strut is slidable in the thrust receiver.

7. The wheeled walker according to claim 1, wherein the platform trails within a surface when the combination drives around a turn wherein the surface is laterally delimited by radial planes of the second wheel pair.

8. The wheeled walker according to claim 1, wherein the platform is foldable along a longitudinal axis that is parallel to the driving direction.

9. The wheeled walker according to claim 1, wherein the coupling arrangement is configured torque proof with respect to a longitudinal axis of the wheeled walker.

10. A wheeled walker, comprising:

a first wheel pair that is in front in a driving direction and a second wheel pair that is behind in the driving direction;

a frame that includes struts that are oriented backward against the driving direction wherein each of the struts supports a rear wheel of the second wheel pair;

a platform that is attached at the wheeled walker and that includes at least one wheel and a standing surface for a person using the wheeled walker; and an electric motor drive that is configured to propel the wheeled walker at least in the driving direction, wherein the standing surface of the platform is arranged between the wheels of the second wheel pair, wherein the wheeled walker includes a coupling arrangement that arranges the platform at the wheeled walker so that tension and compression loads are transferable between the platform and the wheeled walker, and wherein the coupling arrangement is arranged in an intersection portion of a scissor lever that is associated with the wheeled walker.

11. A wheeled walker, comprising:

a first wheel pair that is in front in a driving direction and a second wheel pair that is behind in the driving direction;

a frame that includes struts that are oriented backward against the driving direction wherein each of the struts supports a rear wheel of the second wheel pair;

a platform that is attached at the wheeled walker and that includes at least one wheel and a standing surface for a person using the wheeled walker; and an electric motor drive that is configured to propel the wheeled walker at least in the driving direction, wherein the standing surface of the platform is arranged between the wheels of the second wheel pair, wherein the wheeled walker includes a coupling arrangement that arranges the platform at the wheeled walker so that tension and compression loads are transferable between the platform and the wheeled walker, wherein the platform is arranged below the coupling arrangement in a functional position and supported in the coupling arrangement by a vertical strut, wherein the coupling arrangement includes a thrust receiver which receives the vertical strut so that the vertical strut is slidable in the thrust receiver, and wherein the platform is separable from the coupling arrangement.

* * * * *